US005873349A

United States Patent [19]

Tuckey et al.

[11] Patent Number: 5,873,349

[45] Date of Patent: Feb. 23, 1999

[54] FUEL PRESSURE REGULATOR

[75] Inventors: Charles H. Tuckey, Cass City; G. Clarke Oberheide, Troy, both of Mich.

[73] Assignee: Walbro Corporation, Cass City, Mich.

[21] Appl. No.: 812,597

[22] Filed: Mar. 7, 1997

[51] Int. Cl.[6] ..... F02M 37/04

[52] U.S. Cl. ..... 123/514; 123/509; 137/115.27

[58] Field of Search ..... 137/508, 115, 137/27; 123/514, 509, 508, 457, 447, 456

[56] References Cited

U.S. PATENT DOCUMENTS

| | | | |
|---|---|---|---|
| 5,028,167 | 7/1991 | Brandt | 137/115.27 |
| 5,285,759 | 2/1994 | Terada | 123/514 |
| 5,435,344 | 7/1995 | Robinson | 137/508 |
| 5,509,444 | 4/1996 | Robinson | 123/514 |
| 5,647,328 | 7/1997 | Fournier | 123/509 |
| 5,655,504 | 8/1997 | Iwai | 123/514 |

*Primary Examiner*—Carl S. Miller

*Attorney, Agent, or Firm*—Barnes, Kisselle, Raisch, Choate, Whittemore & Hulbert, P.C.

[57] ABSTRACT

For a fuel injected combustion engine a fuel pressure regulator having a rapidly and accurately regulated output pressure over a wide range of flow rates by bypassing and returning to a fuel tank a portion of the input fuel from a fuel pump through a bypass valve actuated by a flexible diaphragm. The diaphragm is responsive to the pressure of the input fuel on one side of the diaphragm and a vacuum on the other side of the diaphragm having a magnitude which is varied as a function of the flow rate of the fuel bypassed through the valve and returned to the fuel tank. Preferably, this vacuum is produced by a venturi or orifice through which the bypass fuel flows. Applying this vacuum to the diaphragm opposes the bias of a spring acting on the diaphragm and provides an output fuel pressure to the engine over a wide range of flow rates which is essentially constant relative to the atmosphere or, if desired, an output fuel pressure having a positive slope which increases with increasing flow rate of the output fuel supplied to the engine.

20 Claims, 3 Drawing Sheets

FUEL PRESSURE REGULATOR

FIELD OF THE INVENTION

This invention relates to pressure regulators and more particularly to a fuel pressure regulator for an internal combustion engine.

BACKGROUND OF THE INVENTION

In many engines with fuel injection systems, it is desirable to supply liquid fuel to the injector or injectors at a pressure which is either constant relative to atmospheric pressure or varies so that it is constant relative to the pressure drop across the injectors when open which is a function of the intake manifold pressure of the combustion air. Both the combustion air pressure and the flow of fuel supplied to the engine varies with engine speed, load and other operating conditions.

Previously, a variety of fuel pressure regulators have been developed one of which is shown in U.S. Pat. No. 5,579,739. This regulator has a generally flat, flexible diaphragm disposed between two chambers and subjected to manifold pressure on one side and pressurized liquid fuel on the other side. In use, this regulator does not achieve or maintain a uniform and constant differential fuel pressure across the injectors. Rather, the differential fuel pressure varies with the rate of fuel flow and drops as fuel consumption increases. This inconsistent pressure differential across the fuel injectors adversely affects the performance of the engine. Additionally, this regulator does not compensate for dynamic pressure losses in the fuel system between the regulator and the injectors.

SUMMARY OF THE INVENTION

For a fuel injected combustion engine a fuel pressure regulator having a rapidly and accurately regulated output fuel pressure over a wide range of flow rates by bypassing and returning to a fuel tank a portion of the input fuel from a fuel pump through a bypass valve actuated by a flexible diaphragm responsive to the pressure of the input fuel on one side of the diaphragm and to a vacuum applied to the other side of the diaphragm with its magnitude varied as a function of the flow rate of the fuel bypassed through the valve and returned to the fuel tank. Preferably, this vacuum is produced by a venturi or orifice through which the bypass fuel flows. Preferably the diaphragm also provides a closure for the bypass valve and is yieldably biased by a spring towards the closed position of the bypass valve.

Preferably, in one form the venturi communicates with the vacuum side of the diaphragm through a tube carried by the diaphragm and received in the venturi. In another form, bypass fuel flows through an orifice through the diaphragm and is discharged into a bypass passage received in the vacuum side of the diaphragm. This vacuum opposes the bias of a spring acting, on the diaphragm and provides an output fuel pressure to the engine over a wide range of flow rates which is essentially constant relative to the atmosphere or, if desired, an output fuel pressure having, a positive slope which increases with an increasing flow rate of the output fuel supplied to the engine.

Objects, features and advantages of this invention include providing a fuel pressure regulator that delivers fuel to the engine over a wide range of flow rates at a pressure which is essentially constant relative to the atmosphere, can deliver fuel to the engine at an increased pressure when the fuel flow rate to the engine increases, has a diaphragm displaceable to return fuel to the fuel tank is highly and rapidly responsive to changes in the engine fuel demand, permits the fuel pump to operate at a lower pressure when a demand regulator is provided, reduces the pressure differential across a demand regulator when the fuel flow rate to the engine decreases, provides more accurate regulation of fuel pressure to the fuel injectors of a no return system, compensates for increased spring force on the diaphragm which tends to decrease the bypass fuel flow, and is of relatively simple design, economical manufacture and assembly, and in service has a long useful life.

BRIEF DESCRIPTION OF THE DRAWINGS

These and other objects, features and advantages of this invention will be apparent from the following, detailed description of the preferred embodiments and best mode, appended claims and accompanying drawings in which:

DETAILED DESCRIPTION OF THE PREFERRED EMBODIMENTS

Figure 1:
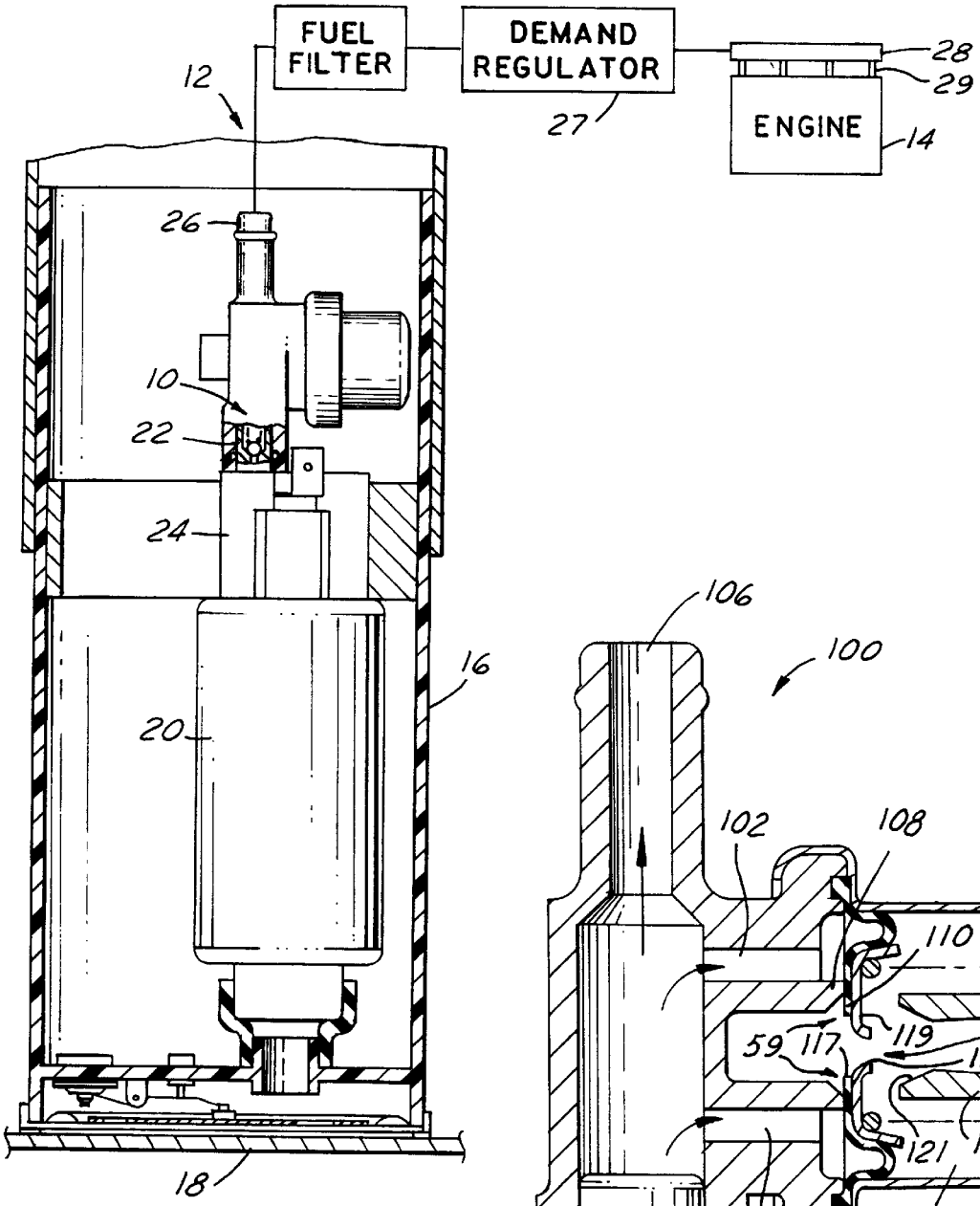
FIG. 1 is a diagrammatic view of a fuel system having, a regulator embodying this invention.

Referring, in more detail to the drawings, FIG. 1 shows a fuel pressure regulator 10 embodying this invention and disposed within a fuel system 12 for an internal combustion engine 14. Preferably, the regulator 10 is disposed between the fuel pump 20 and the engine 14 and interiorly of a fuel pump module 16 within a fuel tank 18. The regulator 10 preferably has a fuel inlet 22, communicating with an outlet 24 of the fuel pump 20 to receive fuel under pressure from the fuel pump 20 and a fuel outlet 26 to deliver fuel under pressure to the engine 14. Preferably, a demand regulator 27 is disposed adjacent to the fuel rail 28 to regulate the pressure at which fuel is delivered to the engine fuel injectors 29 at varying flow rates. If desired, the demand regulator 27 can be manifold referenced to provide fuel to the fuel injectors 29 as a function of the pressure differential across them to supply fuel at a substantially constant pressure differential or pressure drop across the injectors when open. The fuel system 12 does not have any fuel line returning from the fuel rail 28 to the fuel module and is referred to as a no-return or returnless fuel system. A suitable demand regulator 27 is disclosed in U.S. Pat. No. 5,579,739, the disclosure of which is incorporated herein by reference and hence will not be described in further detail.

Figure 2:
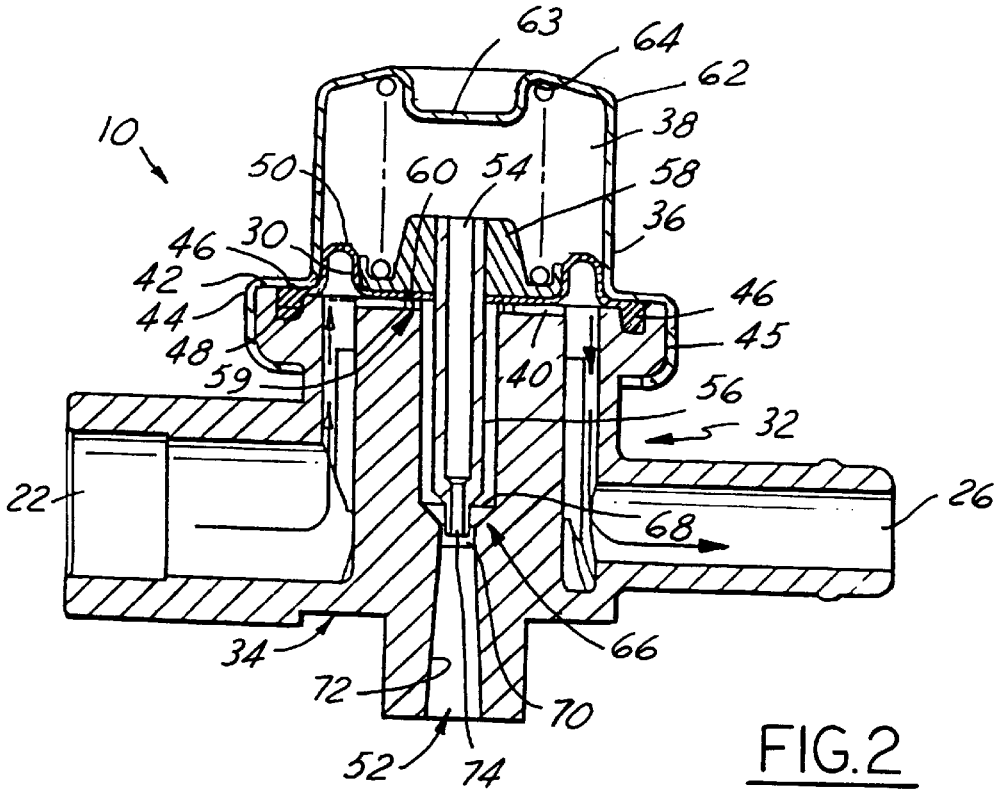
FIG. 2 is a sectional view of a regulator illustrating the diaphragm in a closed position prohibiting fuel flow through the bypass passage.

Referring to FIG. 2, the regulator 10 has a diaphragm 30 received in a housing 32 defined by a body 34 and a cap 36. The diaphragm 30 and cap 36 define a vacuum chamber 38 communicating with one side of the diaphragm 30 and the body 34 and diaphragm 30 define a liquid fuel chamber 40 communicating with the other side of the diaphragm 30. The cap 36 is secured to the housing 32 by a flange 42 with a return bend 44 rolled around a flange 45 of the body 34 during assembly of the components.

The diaphragm 30 has a relatively thin and flexible central portion and a circumferentially continuous peripheral rib 46 received in a groove 48 in the body 34 and retained therein by the cap 36 to provide a fluid tight seal between them and the diaphragm 30. Preferably, to provide a more flexible and responsive diaphragm 30, it has a circumferentially continuous pleat or bellows 50 therein which also readily accommodates substantial axial, radial and pivotal displacement or movement of the diaphragm 30. Preferably, the diaphragm 30 is made of a flexible elastomer such as a flourosilicone rubber or an acrylonitrile butadiene rubber and may be reinforced with a fabric embedded in the elastomer.

The regulator 10 has a bypass passage 52 disposed between the fuel inlet 22 and fuel outlet 26 and in communication with the exterior of the regulator 10 to return a portion of the fuel to the fuel pump module 16 or fuel tank 18 when the fuel flow to the engine is less than the fuel flow delivered by the fuel pump. The diaphragm 30 has an opening 54 in communication with the bypass passage 52, preferably in the form of a vacuum tube 56 which extends through the diaphragm 30 and into the bypass passage 52 to communicate the bypass passage 52 with the vacuum chamber 38. The vacuum tube 56 is carried by a retainer 58 adjacent the diaphragm 30 within the vacuum chamber 38. A bypass valve 59 controls the flow of fuel through the bypass passage 52. Preferably, the valve 59 has an annular seat 60 encircling the passage 52 and engagable by the diaphragm 30 which functions as the valve head. The diaphragm 30 is biased against the seat 60 by a coil spring 62 disposed within the vacuum chamber 38 and having one end received in the retainer 58. To retain the opposite end of the spring 62, the cap 36 is preferably formed with a central prominence 63 and an annular recess 64 extending into the chamber 38.

To create a vacuum to apply to the diaphragm 30, a venturi 66 is disposed in the bypass passage 52 and communicates with the chamber 38 and the diaphragm through the tube 56. Preferably the venturi has a converging and frusto-concial entrance 68 merging into a throat 70 and a diverging frusto-conical exit 72 which reduces the pressure drop of the fuel discharged from the bypass passage. Preferably, the end 74 of the vacuum tube 56 extends into the venturi throat 70 so that when fuel flows through the venturi 66 the pressure drop or vacuum created by the venturi is transmitted through the vacuum tube 56 and into the vacuum chamber 38 to act on the diaphragm 30. The magnitude of the pressure drop varies as a function of the flow rate through the bypass passage and increases with increasing flow rate through the bypass passage.

Figure 3:
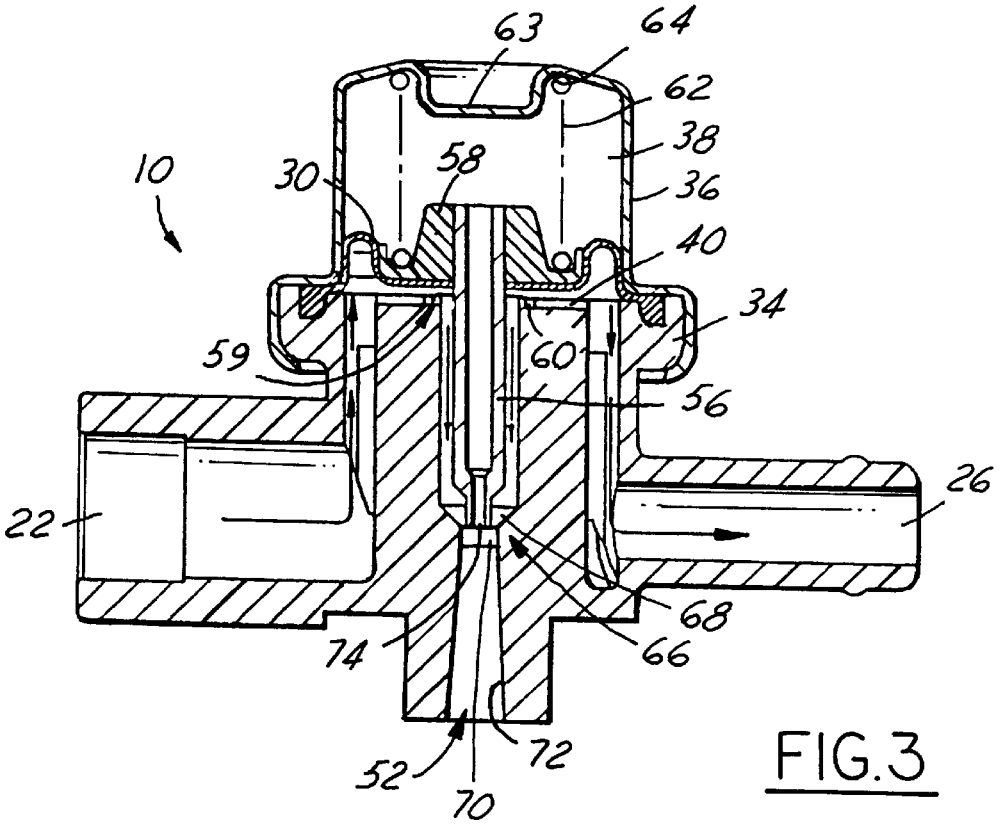
FIG. 3 is a sectional view of the regulator illustrating the diaphragm in an open position allowing fuel flow through the bypass passage.

In use, the fuel pump 20 delivers fuel to the fuel inlet 22 of the regulator 10 preferably at a substantially constant pressure. When there is no fuel flow through the regulator 10 such as when the fuel pump 20 is not operating or when the fuel flow to the engine is as great as the fuel delivered from the fuel pump 20, the diaphragm 30 is biased against the seat 60 adjacent the bypass passage 52, substantially preventing fuel flow through the bypass passage 52. In the latter instance when the fuel pump is operating, fuel flows in the fuel inlet 22 of the regulator 10, through the passage 40 between the diaphragm 30 and the body 34 and out of the fuel outlet 26 of the regulator 10 to the demand regulator adjacent the engine 14. When the fuel flow to the engine is less than the fuel output of the fuel pump 20, the pressure of the fuel on the diaphragm 30 displaces it away from the seat 60 thereby opening the bypass passage 52 to allow the excess fuel to be returned through it to the fuel pump module 16 and fuel tank 18, as shown in FIG. 3. As the fuel flow to the engine 14 decreases, displacement of the diaphragm from its seat increases and the rate of fuel flow through the bypass passage 52 increases.

As the diaphragm is further displaced from its seat, the spring, 62 provides an increased force tending to retard displacement of the diaphragm 30 which would thereby inhibit the flow of fuel through the bypass passage 52 and hence increase the pressure of the output fuel flowing to the engine. However, the drop in pressure or vacuum created by the flow of fuel through the venturi 66 in the bypass passage 52 is transmitted to the vacuum chamber 38 through the vacuum tube 56 within the bypass passage 52. This vacuum in chamber 38 acts on the diaphragm 30 in opposition to the force of the spring 62 and tends to further displace the diaphragm 30 away from the seat 60 and allow increased fuel flow through the bypass passage 52. By designing the venturi 66 of the bypass passage 52, the force and spring rate of the spring, 62, the effective surface area of the diaphragm 30 acted on by the vacuum and the effective surface area of the diaphragm acted on by the fuel, the regulator can be designed to accurately control the pressure of its output fuel delivered to the demand regulator 28 at a generally constant pressure relative to the atmosphere or at a pressure which increases as the flow rate to the engine increases. Usually it is desirable to increase the pressure of the fuel supplied to the demand regulator 27 as the flow rate to the engine increases to compensate for dynamic losses in the fuel system between the regulator 10 and the demand regulator to ensure the engine receives sufficient fuel for its steady operation under varying loads and speeds.

Figure 4:
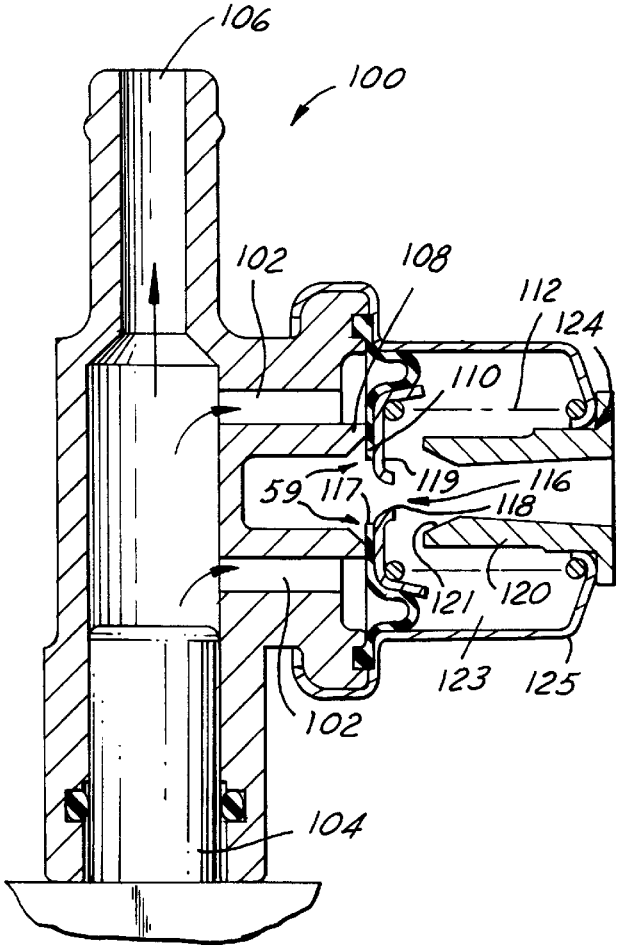
FIG. 4 is a sectional view of another embodiment of a fuel pressure regulator wherein the diaphragm has a central opening through which fuel flows to the bypass passage downstream of the diaphragm.

FIG. 4 shows another embodiment 100 of the present invention having an annular bypass passage 102 disposed between the inlet 104 and outlet 106 of the regulator 100. The bypass passage 102 communicates with the exterior of an annular seat 108 concentrically disposed within the passage 102 against which a diaphragm 110 is biased by a spring 112. The diaphragm 110 has a central opening 114 within the perimeter of the annular seat which communicates with a venturi 116 with a converging entrance 117 and a throat 118 formed in a backing plate 119 disposed between the diaphragm and the spring. Fuel flowing through the venturi passes into a discharge tube 120 having, a diverging and frusto-conical exit passage 122 which decreases the pressure drop of the discharged fuel. Preferably the entrance to the discharge tube 120 has a relatively short converging and frusto-conical inlet portion 121 to insure that all of the fuel flows through the tube and does not enter a vacuum chamber 123 defined by an end cap 125 and the adjacent side of the diaphragm. The inlet end of the discharge tube 120 is spaced from the diaphragm 110 and backing, plate 122 to provide adequate clearance for the maximum displacement of the diaphragm 110 from its associated seat 108. The discharge tube 120 is mounted in a central hole 124 through the end cap 125 preferably with an interference fit which both retains the discharge tube 120 in the end cap 125 and provides a seal between them. The spring 112 encircles the discharge tube with one end received in an annular groove in the casing and the other end received in the backing plate.

In use of this embodiment 100, when the fuel flow to the engine is less than the fuel output of the fuel pump, the pressure of the fuel acts on the diaphragm 110 to displace it away from the seat 108 thereby opening the bypass passage 102 to allow the excess fuel to flow through the venturi 116 and the discharge tube 120 and be returned to the fuel pump module 16 and fuel tank 18. As the fuel flow to the engine decreases, displacement of the diaphragm 110 from its seat 108 increases and the rate of the fuel flow through the venturi 116 and the discharge tube 120 increases. Flow of fuel through the venturi 116 creates a pressure drop or a vacuum in the chamber 123 which acts on the 110 diaphragm 110 in opposition to the force of the spring 112 and tends to urge the diaphragm 110 away from its seat 108 to thereby regulate the pressure of the output fuel in essentially the same manner as the regulator 10 of FIGS. 2 and 3. Consequently, the operation of this regulator 100 will not be described in further detail.

Figure 5:
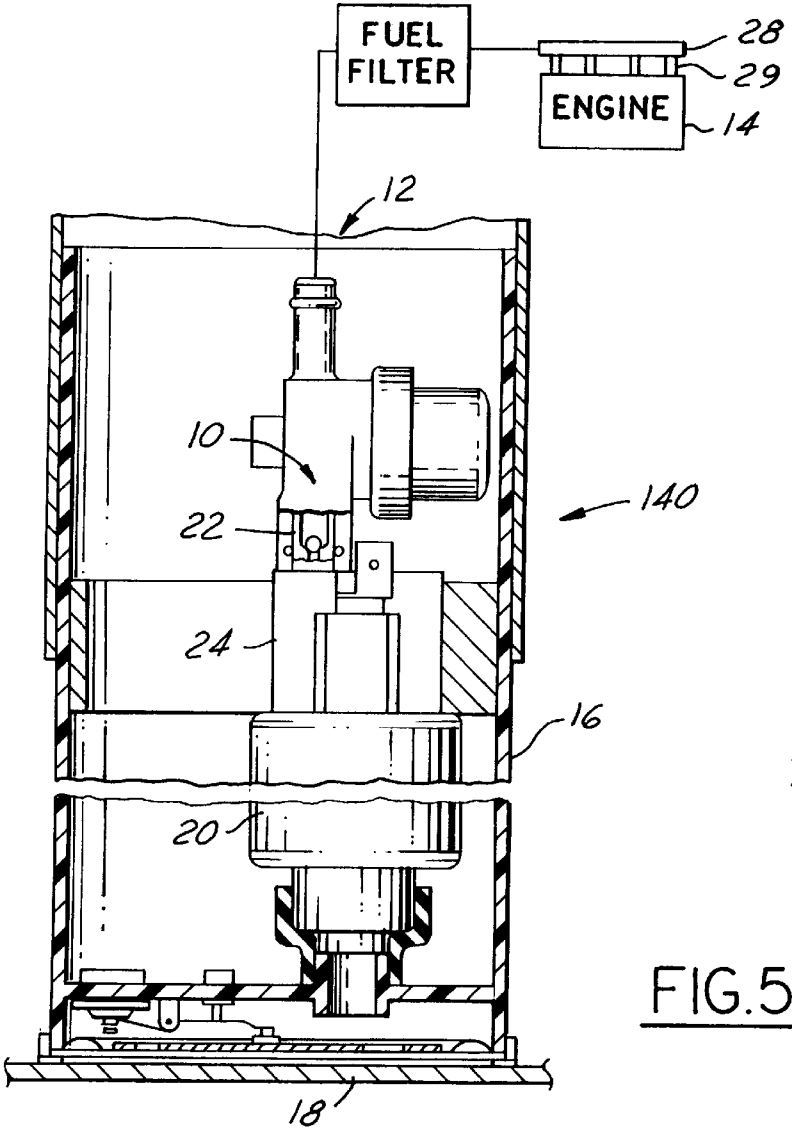
FIG. 5 is a diagrammatic view of an alternate fuel system embodying this invention without a demand regulator adjacent the fuel rail.

FIG. 5 illustrates another fuel system 140 which is the same as the fuel system 12 except that the demand regulator 27 has been eliminated and fuel is supplied directly from the regulator 10 to the engine fuel rail 28 preferably through a fuel filter. Without a demand regulator, in system 140 the regulator 10 can be constructed to actually increase the pressure of the fuel supplied to the engine fuel injectors 14 as the flow rate to the engine increases to extend the dynamic operating range of the fuel injectors. In this system the regulator 10 can produce an output fuel pressure with a positive slope which increases as the flow rate of fuel to the engine increases.

Figure 6:
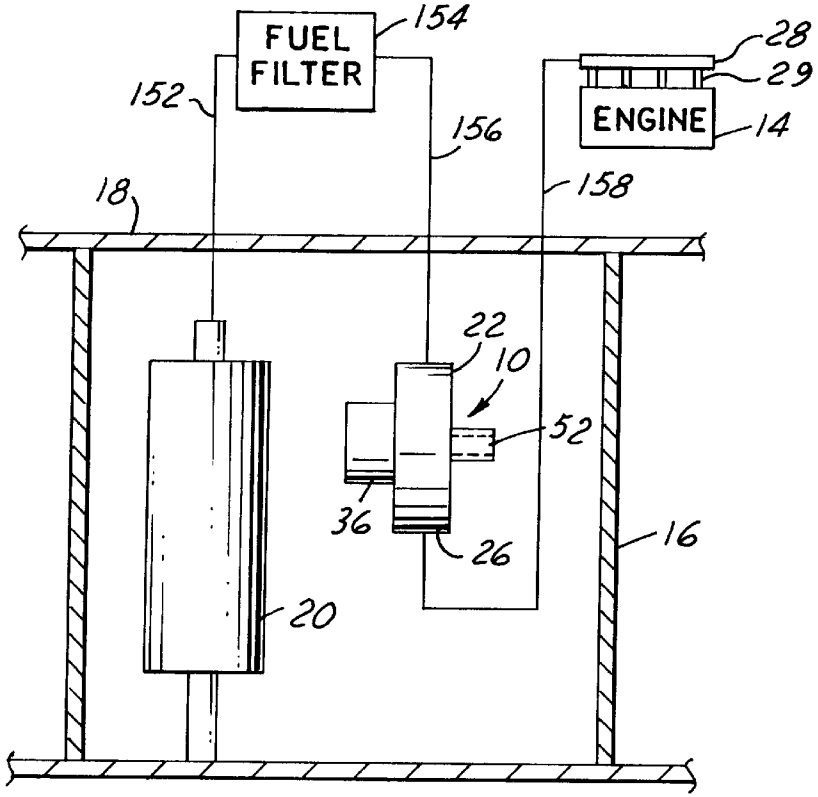
FIG. 6 is a diagrammatic view of an alternate embodiment of a fuel system with a regulator embodying this invention downstream of a fuel filter outside of a fuel tank.

FIG. 6 illustrates a modified fuel system 150 in which the outlet 24 of the fuel pump 20 is connected by a conduit 152 to a fuel filter 154 disposed outside of the fuel tank 18 so that it can be readily changed if it becomes clogged in service and the inlet 22 of the pressure regulator 10 is connected by a conduit 156 to the outlet of the filter. The outlet 26 of the regulator 10 is connected to the fuel rail 18 of the engine 14 by a conduit 158. The regulator 10 is disposed in the module 16 and the bypass fuel is discharged from the regulator outlet 52 into the module 16 and the fuel tank 18. If desired, to facilitate replacement, the regulator 10 could be disposed outside of the fuel tank and its bypass fuel outlet 52 communicated by a short tube with the module 16 in the tank or directly with the tank. By connecting the inlet 22 of the regulator downstream of the filter 154 the performance of the system is not adversely affected by the filter when in use it gradually becomes partially clogged by contaminants removed from the fuel and thus provides increased resistance to fuel flow through the filter.

In use, in each of the described embodiments, the fuel pressure regulators 10, 10', and 100, provide a rapidly and accurately regulated output fuel pressure over a wide range of flow rates by bypassing and returning to the fuel tank 118 a portion of the input fuel through a bypass valve actuated by a flexible diaphragm responsive to the pressure of the input fuel on one side of the diaphragm and on the other side to a vacuum applied to the diaphragm and having a magnitude which is varied as a function of the flow rate of the bypassed fuel. Applying this vacuum to the other side of the diaphragm opposes the bias of the spring acting on the diaphragm and provides an output fuel pressure to the engine over a wide range of flow rates which is essentially constant relative to the atmosphere or, if desired, an output fuel pressure having a positive slope which increases with increasing flow rate of the output fuel supplied to the engine.

We claim:

1. A fuel pressure regulator of the pressure of fuel downstream of the regulator comprising a housing, a fuel flow passage in the housing having a fuel inlet to receive fuel and a fuel outlet to discharge fuel downstream of the regulator, a bypass passage in the housing communicating with the exterior of the housing and selectively communicating with the fuel flow passage, a diaphragm of a flexible elastomeric material carried by the housing and having a pair of generally opposed faces with at least a portion of one face continuously communicating with the fuel flow passage and the elastomeric one face itself providing a closure for a valve seat, a valve seat communicating with the bypass passage and the closure of the one face of the diaphragm being yieldably biased toward a closed position on the seat and actuated by the diaphragm to vary and control the rate of fuel flow through the bypass passage and to the exterior of the housing, a restricted orifice communicating with the bypass passage downstream of the valve seat and communicating with at least a portion of the other side of the diaphragm to apply a partial vacuum thereto when fuel flows through the bypass passage and the restricted orifice to bias the diaphragm toward the fully open position of the valve closure, and the restricted orifice and diaphragm are constructed and sized to regulate the pressure of fuel downstream of the regulator to a pressure which is one of substantially constant or increasing with increasing flow rate of fuel downstream of the regulator over a wide range of downstream fuel flow rates.

2. The regulator of claim 1 wherein the bypass passage extends through the diaphragm.

3. The regulator of claim 1 wherein the orifice is a portion of the bypass passage that is smaller in diameter than the rest of bypass passage to create a fluid pressure drop adjacent the orifice when fuel flows therethrough.

4. The regulator of claim 1 also comprising a passage communicating the orifice with at least a portion of the other side of the diaphragm.

5. The regulator of claim 4 wherein the passage is received in an opening through the diaphragm.

6. The regulator of claim 5 wherein the passage is operably associated with the diaphragm.

7. The regulator of claim 1 wherein the bypass passage extends through the diaphragm and the orifice is downstream of the diaphragm so that when the diaphragm is displaced from the seat fuel flows through the diaphragm and the orifice creating, a pressure drop communicated with at least a portion of the other side of the diaphragm.

8. The regulator of claim 1 wherein the orifice is in the bypass passage downstream of the valve.

9. The regulator of claim 1 also comprising a vacuum port in the housing constructed to communicate the partial vacuum exteriorly of the housing.

10. The regulator of claim 1 wherein the pressure of the fuel downstream of the regulator increases with increasing rate of fuel flow downstream of the regulator.

11. The regulator of claim 1 wherein the fuel inlet of the fuel flow passage is in communication with a fuel line of a fuel system downstream of a fuel pump to influence the pressure of the fuel in the fuel line downstream of the regulator.

12. The regulator of claim 11 wherein the regulator provides an increased fuel pressure in the fuel line downstream of the regulator with increasing fuel flow rates through the fuel line.

13. The regulator of claim 11 also comprising a demand regulator in communication with the fuel line downstream of the pressure regulator.

14. The regulator of claim 12 also comprising a demand regulator in communication with the fuel line downstream of the pressure regulator.

15. The regulator of claim 11 also comprising a filter through which fuel in the fuel line flows and the pressure regulator communicates with the fuel line downstream of the filter.

16. The regulator of claim 1 which also comprises a demand regulator downstream of the pressure regulator and communicating therewith, the demand regulator supplying fuel to an engine and being adjacent the engine.

17. The regulator of claim 16 wherein the demand regulator is manifold referenced to the engine.

18. The regulator of claim 1 which also comprises a spring yieldably biasing the diaphragm toward the closed position of the valve.

19. The regulator of claim 1 wherein the fuel downstream of the pressure regulator is delivered to the engine at a pressure controlled by the pressure regulator.

20. The regulator of claim 1 wherein the pressure of the fuel downstream of the pressure regulator increases with decreasing rate of fuel flow through the bypass passage.

* * * * *